US007213492B2

(12) United States Patent
Tsai

(10) Patent No.: US 7,213,492 B2
(45) Date of Patent: May 8, 2007

(54) CONTROL MECHANISM FOR A SOCKET WRENCH

(76) Inventor: Chen-Chang Tsai, PO Box 82-144, Taipei (TW)

( * ) Notice: Subject to any disclaimer, the term of this patent is extended or adjusted under 35 U.S.C. 154(b) by 139 days.

(21) Appl. No.: 10/975,459

(22) Filed: Oct. 29, 2004

(65) Prior Publication Data

US 2006/0090608 A1 May 4, 2006

(51) Int. Cl.
*B25B 13/46* (2006.01)

(52) U.S. Cl. ..... 81/59.1; 81/62

(58) Field of Classification Search ..... 81/59.1, 81/60–63.2; 192/44–45.1
See application file for complete search history.

(56) References Cited

U.S. PATENT DOCUMENTS 1,412,688 A * 4/1922 Layton et al. ..... 192/45
3,438,291 A * 4/1969 Bergquist ..... 81/62
6,253,646 B1 * 7/2001 Chang ..... 81/59.1
6,769,328 B1 * 8/2004 Patel et al. ..... 81/59.1
6,807,881 B2 * 10/2004 Wu ..... 81/59.1
2004/0007097 A1 * 1/2004 Matsumoto et al. ..... 81/59.1

* cited by examiner

*Primary Examiner*—Hadi Shakeri

(57) ABSTRACT

An effective control mechanism for a socket wrench that is capable of safe, high efficiency, high strength torque control while eliminating the problem of losing control due to improperly applied external force. The control mechanism includes a handle, a socket, an inner rotor, a C-washer, a ring spacer, a dialer, left and right auxiliary positioning levers, a control, a spring, a lid, a roller, and an elastic member; wherein an end of the handle includes a segment channel to accommodate the socket and the inner rotor, the socket includes one or multiple elastic member and one or multiple roller in relation to the segment channel, and multiple locking holes being provided on the recessed surface of the end of the handle for installation of both of the left and the right auxiliary positioning levers and the spring.

1 Claim, 3 Drawing Sheets

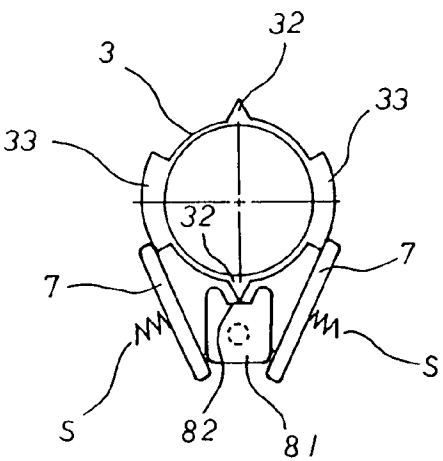
FIG. 2
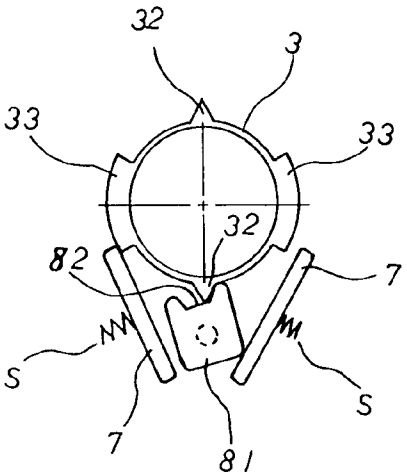
FIG. 3
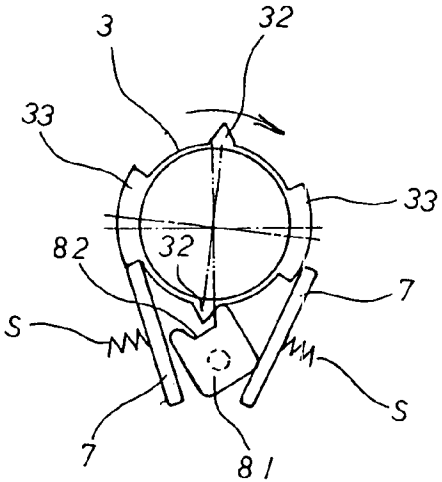
FIG. 4
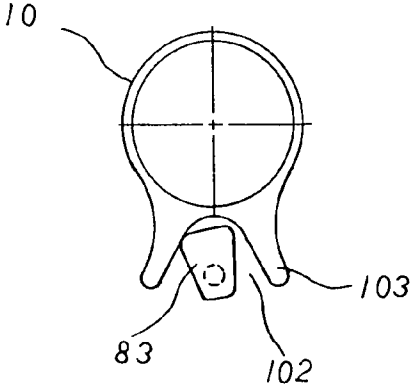
FIG. 6
FIG. 7
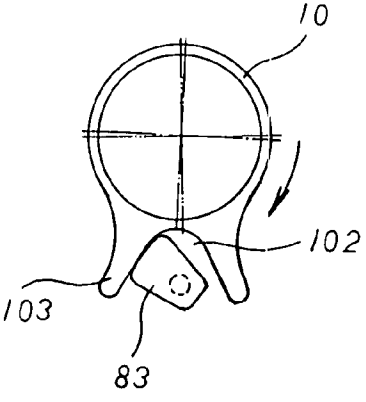
FIG. 8

CONTROL MECHANISM FOR A SOCKET WRENCH

BACKGROUND OF THE INVENTION (a) Technical Field of the Invention

The present invention is related to a control mechanism for a socket wrench, and more particularly to one which provides safe, high efficiency, and high strength torque control.

(b) Description of the Prior Art

Socket wrenches generally available in the market are generally classified into two types, ratchet and roller. The ratchet type operates on having an inner rotor having a serrated surface adapted with a control mechanism comprised of left and right retainers, spring and rotor, primary control and box of the wrench. However, the major flaw of the ratchet type socket wrench is that it is prevented from operating in a very limited space for being subject to the angle of the serration. As for the roller type socket wrench operates on a simple construction of socket, roller and inner rotor. Wherein, pits and steel beads are provided on the rotor and pressure spring being provided to work with those pits. However, the roller type socket wrench is vulnerable to become out of control thus to cause injury to the user when subject to improperly or excessively applied external force. Furthermore, the simple construction often results in poor torque and strength to fail the exact control of torque. Therefore, either the ratchet or the roller type of socket wrench fails to meet the design requirements of high torque, high strength, and minute working space today.

SUMMARY OF THE INVENTION

The primary purpose of the present invention is to provide an effective control mechanism for a torque-indicating socket wrench that is capable of safe, high efficiency, high strength torque control while eliminating the problem of losing control due to improperly applied external force.

Another primary purpose of the present invention is to provide an effective control mechanism for a torque-indicating socket wrench that achieves the force application on the socket wrench without being restricted by the angle, displacement by rotation, and distance of the torque indication. To achieve the purpose, a resistance interface device comprised of socket, roller and elastic member is held in position to link the operation of the inner rotor and the handle.

Yet another purpose of the present invention is to provide an effective control mechanism for a torque-indicating socket wrench that prevents failure of the torque control. To achieve the purpose, the auxiliary positioning lever effectively contains the socket after the socket rotates to fend off abnormal falling off position by the spring compressed due to improper application of force or vibration from external source to ensure the solid control of the direction and positioning of the force applied.

Still another purpose of the present invention is to provide an effective control mechanism for a torque-indicating socket wrench that prevents skid to secure effective transmission of torque. To achieve the purpose, a segment channel is provided in the box to facilitate the slide of the roller.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2 is a schematic view showing operation of the first preferred embodiment of the present invention in its normal positioning status.

FIG. 3 is a schematic view showing a post control in the first preferred embodiment of the present invention indicating a deflection for approximately fifteen degrees.

FIG. 4 is a schematic view showing the post control in the first preferred embodiment of the present invention indicating a deflection for approximately thirty degrees.

FIG. 6 is a schematic view showing operation of the second preferred embodiment of the present invention in its normal positioning status.

FIG. 7 is a schematic view showing a post control in the second preferred embodiment of the present invention indicates a deflection for approximately fifteen degrees.

FIG. 8 is a schematic view showing the post control in the second preferred embodiment of the present invention indicates a deflection for approximately thirty degrees.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
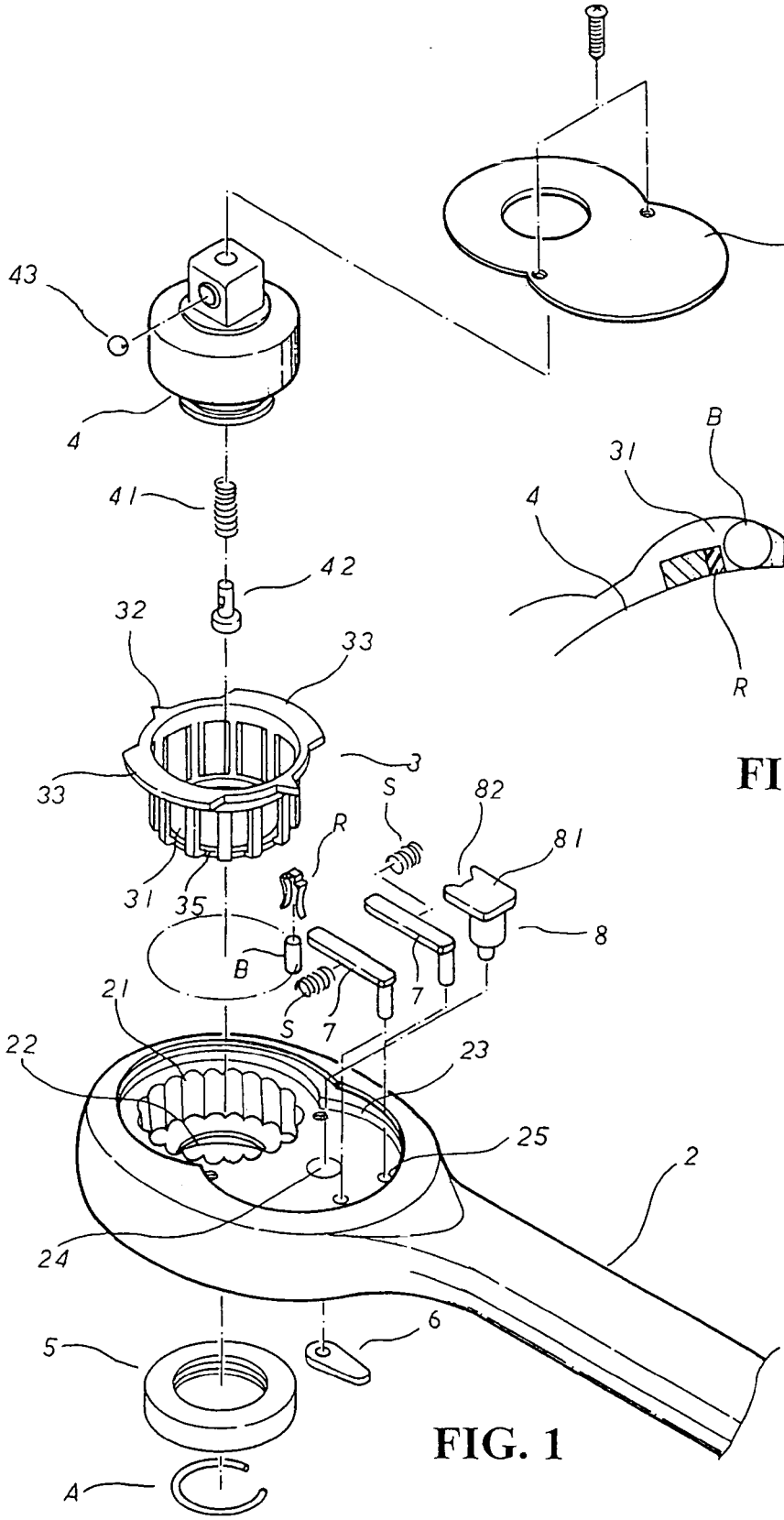
FIG. 1 is a perspective view of a first preferred embodiment of the present invention.
Figure 9:
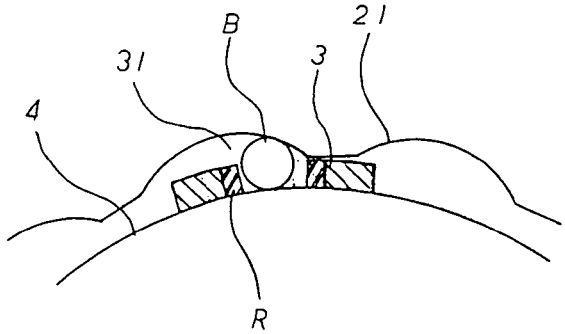
FIG. 9 is a schematic view showing the arrangement of members of the present invention in use.

Referring to the accompanying drawings, a first preferred embodiment of the present invention is essentially comprised of a handle 2, a socket 3, an inner rotor 4, a C-washer A, a ring spacer 5, a dialer 6, an auxiliary positioning lever 7, a control 8, a spring S, a lid 9, a roller B and an elastic member R. Wherein, one or multiple segment channel 21 is provided to one end of the handle 2 to accommodate the socket 3 and the inner rotor 4. One or multiple resilient member R and one or multiple roller B is fixed to the socket 3 in relation to the operation of the segment channel 21. A cavity 22 is formed at the bottom of the end of the handle 2 for receiving the C-washer A and the ring spacer 5. A larger locking hole 25 and multiple smaller locking holes 25 are provided on a recessed surface 23 of the handle 2 below the cavity 22 of the end of the handle 2 to house the control 8, a left and a right auxiliary positioning levers 7, and the spring S. The bottom of the control 8 is fixed to the dialer and locked in position by means of the lid 9 in a contour similar to that of the recessed surface 23. One or multiple segregation channel 31 is provided on the lower section of the socket and multiple ribs are arranged vertically into an annular member provided at the lower end with a reinforced ring 35. The upper end of the annular member is provided with two serrated sections 32 facing each other and each provided with a tip, and another two wing retainers 33 facing to each other. The control 8 has a plate 81 provided at it upper end and a graded gap 82 on the distal end of the plate 81 corresponding to the tip of the serrated section 32. Both of the left and the right auxiliary positioning Levers 7 are pushed by the spring S to produce a force to compress in so that the tip of each auxiliary positioning lever 7 merely rests upon the outer edge of the wing retainer 33 as illustrated in FIGS. 1 and 4 in normal positioning status. Accordingly, the socket 3, the roller B, and the elastic member R execute the resistance interface linkage between the inner rotor 4 and the segment channel 21 as illustrated in FIG. 9 so to provide effective linkage of high torque and torque indication operation for the segment channel 21 to rotate and travel along with the inner rotor 4 as driven by the externally applied force.

When the handle 2 is desired to rotate clockwise, the dialer 6 is pushed in opposition direction for the plate 81 of the control 8 to deflect for approximately fifteen degrees to push away the auxiliary positioning lever 7 on the right as illustrated in FIG. 3 until the plate 81 deflects for approximately thirty degrees, the graded gap 82 of the plate 81 dials the socket 3 to rotate. Meanwhile the left auxiliary positioning lever 7 merely prevents the socket 3 to travel in opposite direction when the spring S forces to push and secure in the socket 3 by locking to the end of the wing retainer 33 as illustrated in FIG. 4. Wherein, the socket is forced to only rotate clockwise to free from falling off due to improper application of external force. The roller B and the elastic member R are tightly contained by the segment channel 21 for the inner rotor 4 and incorporated into one piece with the handle to prevent relative motion between the segment channel 21 and the inner rotor 4. Accordingly, the handle 2 achieves its purpose of transmitting the torque as the inner rotor 4 rotates. The operation in reverse direction provides the handle 2 to execute the rotation in opposite direction. The return travel by the handle 2 is completed with the rotation of the inner rotor 4 in opposite direction to drive the roller B and the elastic member R to disengage from the segment channel 21. Accordingly, the inner rotor 4 is disengaged from the handle 2 to quit the synchronous rotation between the inner rotor 4 and the handle 2. Whereas the return travel will cause the wrench to idle, the effective transmission of torque is delivered.

Figure 5:
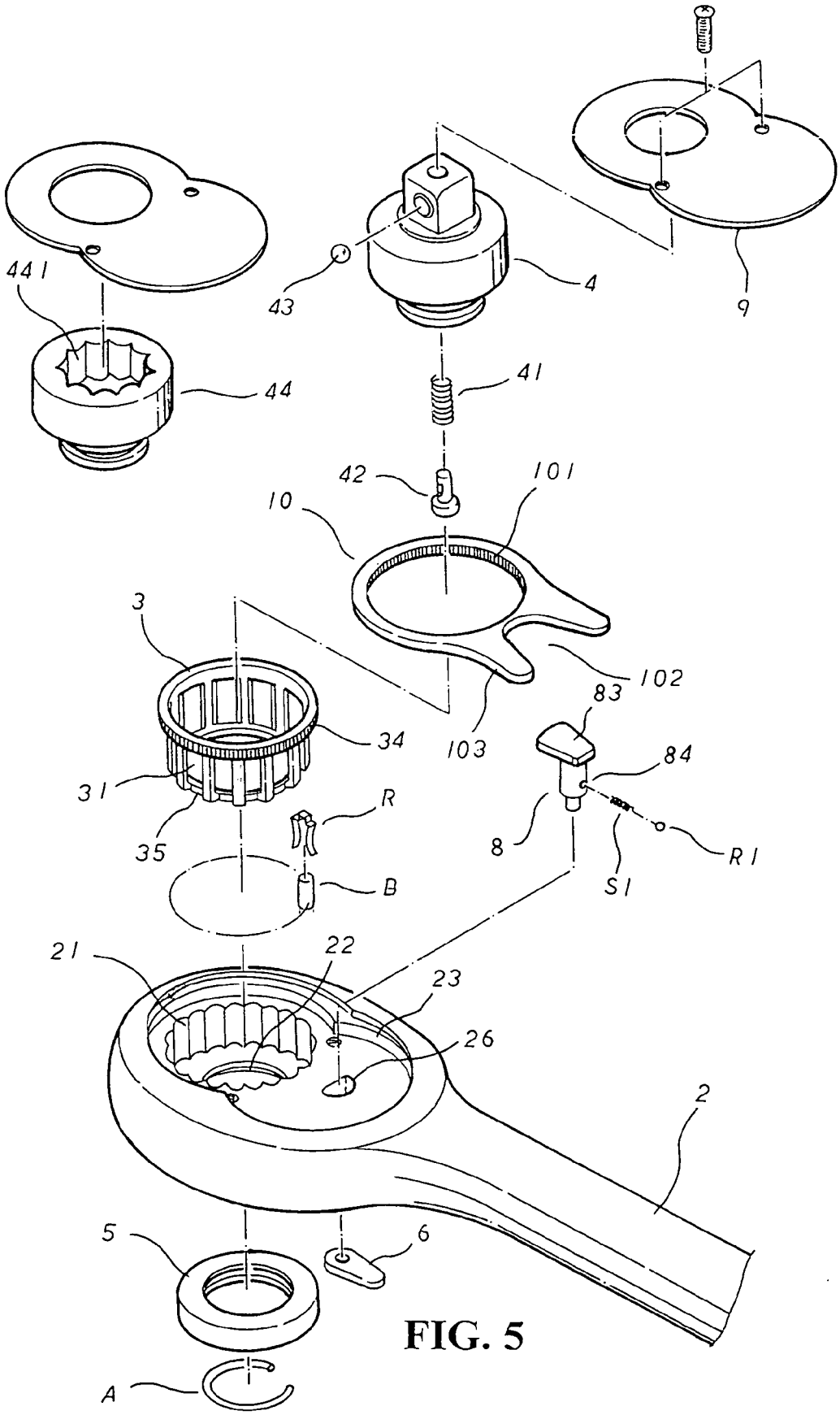
FIG. 5 is a perspective view of a second preferred embodiment of the present invention.

Furthermore, in the second preferred embodiment of the present invention as illustrated in FIG. 5, the outer circumference 34 of the socket 3 is serrated to engage with a serrated inner circumference 101 of a horseshoe shape spacer 10. Two retainers 103 extending from one side of the spacer 10 define a gap 102. The larger hole 24 in the first preferred embodiment is changed to a locking hole 26 in arc adapted with another type of control 8. The control has a trapezoid top plate 83 and the body of the control 8 is provided with a hole 84 containing a smaller spring S1 and a steel bead R1 to provide powerful positioning result. Accordingly, the control 8 produces compression upon both retainers 103 in relation to the rotation by the dialer 6; and finally, the spacer 10 provides the its positioning feature when the center of the spacer 10 through the retainer 103, the trapezoid plate 83 of the control 8 to the center of the control 8 define the optimal positioning location of ninety degrees as illustrated in FIGS. 5 and 6. Wherein, a clearance is reserved between the peripheral of the plate 83 and the gap 102 in normal status. When the handle 2 is desired to rotate clockwise, the dialer 6 must be first pushed in opposite direction for the control 8 when deflected for approximately fifteen degrees will have the front end of its top plate 83 to contact the retainers 103 as illustrated in FIG. 7; and when the control 8 is deflected for approximately thirty degrees, the tip of the plate 83 while dialing to move the spacer 10 drives the socket 3 to rotate for achieving the optimal location at ninety degrees. Meanwhile, the smaller spring S1 and steel beard R1 provide their positioning feature to merely maintain effective positioning and stopping the socket to rotate in opposite direction for displacement, thus to prevent from losing control due to the improperly applied external force as illustrated in FIG. 8 since the socket is allowed to rotate in positive direction only.

The roller B and the elastic member R are tightly contained by the segment channel 21 for the inner rotor 4 and incorporated into one piece with the handle to prevent relative motion between the segment channel 21 and the inner rotor 4. Accordingly, the handle 2 achieves its purpose of transmitting the torque as the inner rotor 4 rotates. The operation in reverse direction provides the handle 2 to execute the rotation in opposite direction. The return travel by the handle 2 is completed with the rotation of the inner rotor 4 in opposite direction to drive the roller B and the elastic member R to disengage from the segment channel 21. Accordingly, the inner rotor 4 is disengaged from the handle 2 to quit the synchronous rotation between the inner rotor 4 and the handle 2. Whereas the return travel will cause the wrench to idle, the effective transmission of torque is delivered.

Furthermore, a dice on the upper part of the inner rotor 4 containing a spring 41, a steel bead 43, and an escape switch 42 is removed and replaced with another inner rotor 44 containing a channel 441 in a geometric form of an arc segment, tetragon, hexagon, octagon, or dodecagon to meet the insertion of various types of parts for the torque control.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A control mechanism for a socket wrench comprising:

a handle having an end provided with a plurality of segment channels, said end having a bottom formed with a cavity, said end being formed with a recessed surface having a plurality of small locking holes and a large locking hole;

a socket fitted in said end of said handle, said socket having a lower portion provided with a plurality of segregation channels and ribs arranged vertically into an annular member with a reinforced ring at a lower end of said annular member, an upper end of said annular member being provided with two opposite serrated sections and two opposite wing retainers;

an inner rotor fitted in said socket;

a C-washer fitted in said cavity of said end of said handle;

a ring spacer fitted in said cavity of said end of said handle and disposed above said C-washer;

a dialer connected with a bottom of said control;

two auxiliary positioning levers having an end engaged with a respective one of said small locking holes;

a control having an end engaged with said large locking hole, said control having an upper end provided with a plate and a graded gap corresponding to a tip of said serrated sections;

two springs pushing said auxiliary positioning levers to go inwardly, an end of each of said auxiliary positioning levers resting upon an outer edge of said wing retainers;

a lid having a contour similar to a contour of said recessed surface and locked on said recessed surface to keep said control in place;

a roller arranged between said inner rotor and said segment channel; and an elastic member fitted over said roller.

* * * * *